United States Patent [19]

Forester

[11] Patent Number: 5,064,524

[45] **Date of Patent: * Nov. 12, 1991**

[54] PASSIVATION OF FCC CATALYSTS

[75] Inventor: David R. Forester, Spring, Tex.

[73] Assignee: Betz Laboratories, Inc., Trevose, Pa.

[ * ] Notice: The portion of the term of this patent subsequent to Apr. 3, 2007 has been disclaimed.

[21] Appl. No.: 500,426

[22] Filed: Mar. 28, 1990

Related U.S. Application Data

[63] Continuation of Ser. No. 208,202, Jun. 17, 1988, Pat. No. 4,913,801.

[51] Int. Cl.[5] ..... C10G 11/18

[52] U.S. Cl. ..... 208/121; 208/52 CT; 208/113

[58] Field of Search ..... 208/120, 113, 52 CT; 502/521

[56] References Cited

U.S. PATENT DOCUMENTS

| | | | |
|---|---|---|---|
| 3,711,422 | 1/1973 | Johnson et al. | 252/414 |
| 3,823,092 | 7/1974 | Gladrow | 252/455 |
| 3,977,963 | 8/1976 | Readal et al. | 208/120 |
| 4,025,458 | 5/1977 | McKay | 252/416 |
| 4,101,417 | 7/1978 | Mitchell et al. | 208/120 |
| 4,111,845 | 9/1978 | McKay | 252/455 |
| 4,141,858 | 2/1979 | McKay | 252/439 |
| 4,166,806 | 9/1979 | McKay et al. | 252/437 |
| 4,167,471 | 9/1979 | Bertus et al. | 208/74 |
| 4,169,042 | 9/1979 | McKay | 208/113 |
| 4,169,784 | 10/1979 | Nielson et al. | 208/113 |
| 4,178,267 | 12/1979 | McKay | 252/411 |
| 4,183,803 | 1/1980 | McKay | 208/120 |
| 4,208,302 | 6/1980 | McKay | 252/411 R |
| 4,218,337 | 8/1980 | McKay | 252/411 R |
| 4,238,367 | 12/1980 | Bertus et al. | 252/455 Z |
| 4,255,287 | 3/1981 | Bertus et al. | 252/455 Z |
| 4,256,564 | 3/1981 | Roberts et al. | 208/120 |
| 4,263,172 | 4/1981 | McKay | 252/439 |
| 4,268,188 | 5/1981 | McKay et al. | 405/128 |
| 4,283,274 | 8/1981 | Bertus et al. | 208/120 |
| 4,289,608 | 9/1981 | McArthur | 208/121 |
| 4,290,919 | 9/1981 | McKây et al. | 252/437 |
| 4,295,955 | 10/1981 | Tu | 208/120 |
| 4,310,410 | 1/1982 | McKay | 208/120 |
| 4,312,744 | 1/1982 | Tu et al. | 208/120 |
| 4,319,983 | 3/1982 | Yoo | 208/114 |
| 4,324,648 | 4/1982 | Roberts et al. | 208/114 |
| 4,331,563 | 5/1982 | McKay | 252/455 Z |
| 4,334,979 | 6/1982 | Bertus et al. | 208/114 |
| 4,335,021 | 6/1982 | McKay | 252/455 R |
| 4,348,273 | 9/1982 | Nielsen | 208/113 |
| 4,348,304 | 9/1982 | Roberts et al. | 252/455 Z |
| 4,363,720 | 12/1982 | Hirschberg et al. | 208/120 |
| 4,364,847 | 12/1982 | Tu | 252/412 |
| 4,377,494 | 3/1983 | Bertus et al. | 252/411 R |
| 4,377,504 | 3/1983 | Roberts et al. | 252/455 Z |
| 4,386,015 | 5/1983 | Bertus et al. | 252/455 Z |
| 4,397,767 | 8/1983 | Roberts et al. | 252/431 P |
| 4,411,777 | 10/1983 | McKay | 208/120 |
| 4,415,440 | 11/1983 | Roberts et al. | 208/120 |
| 4,430,199 | 2/1984 | Durante et al. | 208/114 |
| 4,432,890 | 2/1984 | Beck et al. | 502/62 |
| 4,437,981 | 3/1984 | Kovach | 208/253 |
| 4,439,536 | 3/1984 | Bertus et al. | 502/64 |
| 4,469,588 | 9/1984 | Hettinger et al. | 208/77 |
| 4,473,463 | 9/1984 | Bertus et al. | 208/120 |
| 4,490,299 | 12/1984 | Bertus et al. | 260/429 K |
| 4,508,839 | 4/1985 | Zandona et al. | 502/65 |
| 4,513,093 | 4/1985 | Beck et al. | 502/84 |
| 4,515,683 | 5/1985 | Beck et al. | 208/113 |
| 4,535,066 | 8/1985 | Mark et al. | 502/62 |
| 4,549,958 | 10/1985 | Beck et al. | 208/253 |
| 4,576,709 | 3/1986 | Miller et al. | 208/57 |
| 4,584,283 | 4/1986 | Bertus et al. | 502/31 |
| 4,601,815 | 7/1986 | Forester | 208/120 |
| 4,634,517 | 1/1987 | Tauster et al. | 208/138 |
| 4,664,779 | 5/1987 | Bertus et al. | 208/114 |
| 4,664,780 | 5/1987 | Lochow et al. | 208/120 |
| 4,728,629 | 3/1988 | Bertus et al. | 502/62 |
| 4,913,801 | 4/1990 | Forester | 208/121 |

FOREIGN PATENT DOCUMENTS

| | | | |
|---|---|---|---|
| 3634304 | 9/1987 | Fed. Rep. of Germany | 208/88 |

OTHER PUBLICATIONS

"Vanadium Poisoning of Cracking Catalysts . . . ", J. Catal. 100. pp. 130–137, 1986 Wormsbecher et al.

"Resarch & Development Directed at Resid Cracking", Campagna et al., Oil & Gas Jour, Oct. 31, 1983, pp. 128–134.

"Reduce FCC Fouling", Barlow, Hydrocarbon Processing, Jul. 1986.

"A Look at New FCC Catalysts For Resid", Ritter et al., Technology, Oil & Gas Journal, Jul. 6, 1981, pp. 103–111.

"Catalagram", No. 64, W. R. Grace & Co. Davison Chemical Div., 1982.

"Catalagram", No. 68, W. R. Grace & Co. Davison Chemical Div., 1984.

*Primary Examiner*—Anthony McFarlane

*Attorney, Agent, or Firm*—Alexander D. Ricci; Philip H. Von Neida

[57] ABSTRACT

The present invention is directed to a method of using cerium and/or cerium containing compounds to passivate nickel contaminants in hydrocarbon feedstocks which are used in catalytic cracking processes.

12 Claims, No Drawings

PASSIVATION OF FCC CATALYSTS

This is a continuation of application Ser. No. 07/208,202, filed June 17, 1988, now U.S. Pat. No. 4,913,801.

BACKGROUND OF THE INVENTION

1. Field of the Invention

This invention relates to the art of catalytic cracking of hydrocarbons, and in particular to methods of inhibiting on zeolite catalysts the detrimental effects of contamination by metals, particularly nickel, which are contained in the hydrocarbon feedstock.

Major metal contaminants that are found in Fluid Catalytic Cracker (FCC) feedstocks include nickel, vanadium, iron, copper and occasionally other heavy metals. The problems associated with metal contamination, particularly nickel, during the catalytic cracking of hydrocarbons to yield light distillates such as gasoline are documented in Oil & Gas Journal of July 6, 1981, on pages 103–111 and of Oct. 31, 1983 on pages 128–134. The problems associated with vanadium metal contamination are described in U.S. Pat. No. 4,432,890 and German Patent No. 3,634,304. The invention herein represents an innovation and improvement over those processes set forth and claimed in U.S. Pat. No. 4,432,890 and German Patent No. 3,634,304.

It is well known in the art that nickel significantly increases hydrogen and coke and can cause decreases in catalyst activity. Vanadium primarily decreases activity and desirable gasoline selectivity by attacking and destroying the zeolite catalytic sites. Its effect on the activity is about four times greater than that of nickel. Vanadium also increases hydrogen and coke, but at only about one fourth the rate of nickel.

The reducing atmosphere of hydrogen and carbon monoxide in the cracking zone reduces the nickel and vanadium to lower valence states. The nickel is an active dehydrogenating agent under these circumstances, increasing hydrogen and coke which also leads to a small decrease in conversion activity.

Vanadium has been shown to destroy active catalytic sites by the movement of the volatile vanadium pentoxide through the catalyst structure. Lower oxides of vanadium are not volatile and are not implicated in the destruction of catalyst activity. In the cracking zone, lower oxides of vanadium will be present and vanadium pentoxide will be absent. Thus in the cracking zone, fresh vanadium from the feedstock will not reduce activity. When the lower valence vanadium compounds enter the regenerator where oxygen is present to combust the coke, the vanadium compounds are oxidized to vanadium pentoxide which then can migrate to active sites and destroy the active sites, leading to a large reduction in activity and selectivity, particularly gasoline.

An increase in hydrogen and coke due to contaminant metals translates to a decrease in yields of desirable products such as gasoline and light gases (propane/butanes). Also, increases in hydrogen yield require extensive processing to separate the cracked products and can result in operation and/or compressor limitations.

While the coke that is produced during the catalytic cracking process is used to keep the unit in heat balance, increases in coke yields mean increased temperatures in the regenerator which can damage catalysts by destroying the zeolitic structures and thus decrease activity.

As activity is destroyed by contaminant metals, conversion can be increased by changing the catalyst to oil ratio or by increasing the cracking temperature, but coke and hydrogen will also be increased in either case. For best efficiency in a FCC unit, the activity should be kept at a constant level.

However, as vandium is deposited on the catalyst over and above about a 3,000 ppm level, significant decreases in activity occur. Passivators have been used to offset the detrimental effects of nickel and of vanadium.

Numerous passivating agents nave been taught and claimed in various patents for nickel. Some examples include antimony in U.S. Pat. Nos. 3,711,422, 4,025,458 4,111,845, and sundry others; bismuth in U.S. Pat. Nos. 3,977,963 and 4,141,858; tin in combination with antimony in U.S. Pat. No. 4,255,287; germanium in U.S. Pat. No. 4,334,979; gallium in U.S. Pat. No. 4,377,504 tellurium in U.S. Pat. No. 4,169,042; indium in U.S. Pat. No. 4,208,302; thallium in U.S. Pat. No. 4,238,367; manganese in U.S. Pat. No. 3,977,963; aluminum in U.S. Pat. No. 4,289,608, zinc in U.S. Pat. No. 4,363,720; lithium in U.S. Pat. No. 4,364,847; barium in U.S. Pat. No. 4,377,494; phosphorus in U.S. Pat. No. 4,430,199; titanium and zirconium in U.S. Pat. No. 4,437,981; silicon in U.S. Pat. No. 4,319,983; tungsten in U.S. Pat. No. 4,290,919; and boron is U.S. Pat. No. 4,295,955.

Examples of vanadium passivating agents are fewer, but include tin in U.S. Pat. Nos. 4,101,417 and 4,601,815; titanium, zirconium, manganese, magnesium, calcium, strontium, barium, scandium, yttrium, lanthanides, rare earths, actinides, hafnium, tantalum, nickel, indium, bismuth, and tellurium in U.S. Pat. Nos. 4,432,890 and 4,513,093; yttrium, lanthanum, cerium and the other rare earths in German 3,634,304.

In general, the passivating agents have been added to the catalyst during manufacture, to the catalyst after manufacture by impregnation, to the feedstock before or during processing, to the regenerator, and/or any combination of the above methods.

2. General Description of the Invention

It was discovered that when a zeolite catalyst contaminated with metals, including nickel, is treated with cerium compounds, the hydrogen-forming property of the nickel was mitigated to a great extent.

While cerium passivates vanadium, it was quite unexpectedly found that cerium also passivates the adverse effects of nickel.

U.S. Pat. Nos. 4,432,890 and 4,513,093 teach that numerous metallic compounds (titanium, zirconium, manganese, magnesium, calcium, strontium, barium, scandium, yttrium, lanthanides, rare earths, actinides, hafnium, tantalum, nickel, indium, bismuth, and tellurium act as vanadium passivators. German Patent No. 3,634,304 claims that yttrium, lanthanides, cerium, and other rare earth compounds passivate the adverse effects of vanadium. In the '890 patent, only titanium was used on an FCC catalyst to show the effects of the various claimed metals on passivating vanadium. Cerium was not specifically mentioned. In each of these patents, nickel was not added to the catalyst undergoing testing and so the effects on hydrogen-make by nickel with cerium passivation could not be observed. In addition, the only vanadium levels tested in these two patents were 5,500 and 3,800 ppm, respectively. Although nickel and vanadium contamination of FCC catalysts is discussed in great depth in the art and in the same context, it is equally clear from the specifics of the art, that each represents its own separate problem as well as solution. It is not evident or expected that any treatment for vanadium would also be effective for nickel or vice-versa.

It is well documented in the art that a certain level of vanadium is necessary on the catalyst to observe a loss of catalyst activity. This level varies with the type of catalyst. In one report the level of vanadium below which catalyst activity is not degraded is 1,000 ppm for that catalyst (see the newsletter Catalagram published by Davison Chemical in 1982, Issue Number 64). In another article (R. F. Wormsbecher, et al., J. Catal., 100, 130-137(1986)), only above 2000 ppm vanadium are catalyst activity and selectivity lost. Other catalysts such as metal resistant catalysts need high levels (above about 3000 ppm) of vanadium where loss of catalyst activity can be observed (Oil & Gas Journal, 103-111, July 6, 1981). From these articles, it can be seen that not all catalysts are significantly affected by lower levels of vanadium contaminant.

Thus, the treatment of specific catalysts containing less than a significant level of vanadium would show very small to insignificant changes in activity on addition of cerium. However, the practical effects of nickel can be observed at levels as low as about 300 ppm, with the amount of hydrogen and coke increasing proportional to the amount of nickel present.

DETAILED DESCRIPTION OF THE INVENTION

As earlier indicated, the invention is directed to a process of passivating nickel contained on a zeolitic cracking catalyst.

The total process generally entails:

a. Contacting a hydrocarbon feedstock with a fluidized zeolite-containing cracking catalyst in a cracking zone under cracking conditions;
b. recovering the cracked products,
c. passing the cracking catalyst from the cracking zone to a regeneration zone;
d. regenerating the cracking catalyst in the regeneration zone by contact with oxygen-containing gas under regeneration conditions to produce a regenerated catalyst; and
e. introducing the regenerated catalyst to the cracking zone for contact with the hydrocarbon feedstock;

wherein the catalyst during the cracking process in contaminated with from about 100 to 5000 parts nickel per million parts of catalyst, with nickel contained in a feedstock at concentrations of up to about 100 ppm, which nickel would increase hydrogen and coke yields at the cracking temperatures and conditions in the cracking zone, and wherein the catalyst contains less than about 3000 ppm of vanadium; the improvement comprising treating the feedstock containing the nickel contaminant with cerium, with the amount of cerium utilized being from 0.005 to 240 ppm on the nickel in the feedstock and at atomic ratios with nickel of from 1:1 to 0.05:1 Ce/Ni, preferable 0.6b:1 to 0.1:1.

Although it is not important as to the form in which the cerium is added to the feedstock, examples of cerium compounds which can be used include cerium in the cerous or ceric state with anions of nitrate (designated $NO_3$ in the examples), ammonium nitrate, acetate, proprionate, butyrate, neopentoate, octoate (Oct), laurate, neodecanoate, stearate, naphthenate, oxalate, maleate, benzoate, acrylate, salicylate, versalate, terephthalate, carbonate, hydroxide, sulfate, fluoride, organosulfonate, acetylacetonate, Beta-diketones, oxide (designated either as $O_2$ for a water based suspension or as Org for a hydrocarbon based suspension in the examples), ortno-phosphate, or combinations of the above.

Generally the cerium compound is fed to the feedstock on a continuous oasis so that enough cerium is present in the feedstock to passivate the nickel contained therein. The cerium concentration in the feedstock will be 0.005 to 240 ppm based on 0.1 to 100 ppm nickel in the feedstock.

The most desirable manner of treating the cracking catalyst with the cerium will be adding a solution or suspension containing the cerium to the feedstock. The solvent used to solubilize or suspend the cerium compound can be water or an organic solvent, preferably a hydrocarbon solvent similar to the hydrocarbon feedstock. The concentration of the cerium in the solvent can be any concentration that makes it convenient to add the cerium to the feedstock.

More detailed information relative to the invention will be evident from the following specific embodiments.

SPECIFIC EMBODIMENTS

In the Examples shown, commercially available zeolite crystalline aluminosilicate cracking catalysts were used. The catalytic cracking runs were conducted employing a fixed catalyst bed, a temperature of 482° C., a contact time of 75 seconds, and a catalyst to oil ratio of about 3:1 or greater as detailed under the catalyst to oil ratio (C/O) in the individual Tables. The feedstock used for these cracking runs was a gas oil feedstock having a boiling range of approximately 500 to 1000° F.

The four zeolitic cracking catalysts that were used are all commercial catalysts that are described as:

Catalyst A—yielding maximum octane enhancement and lowest coke and gas,

Catalyst B—yielding highest liquid product selectivity and low gas and coke make, Catalyst C—yielding highest activity for octane enhancement and stability with low coke and gas make, and Catalyst D—yielding octane enhancement and high stability with low coke and gas make.

Each of the four catalysts were conditioned similarly. The fresh Catalysts A, C, and D were heated in air to 649° C. for 0.5 hour before metals were added. To these conditioned catalysts were added the appropriate ppms of vanadium, and/or nickel, and/or cerium (as designated in the Tables) followed by heating the metals contaminated catalysts in air for 1 hour at 649° C. and then for 6.5 hours in steam at 732° C., or 760° C., or 788° C.

Catalyst B was heated in air at 649° C. for 0.5 hour before metals were added. To the conditioned catalyst was added the appropriate ppms of vanadium and/or nickel and/or cerium (as designated in Table 2) followed by heating the metals contaminated catalyst in air for 1 hour at 649° C. and then for 19.5 hours at 732° C. in steam.

The procedure utilized to test the efficacy of the zeolite catalysts treated in accordance with the present invention is that which is outlined in the ASIM-D-3907, which is incorporated herein by reference.

The weight percent changes in conversion were calculated in the following manner:

Weight % Change Conversion = Wt. % conv. Ce run − Avg. Wt. % conv. metal contaminant rungs The percent changes in hydrogen make were calculated in the following manner:

$$\% \text{ Change Hydrogen} = \frac{(\text{Observed } H_2 \text{ Wt. \%} - \text{Predicted } H_2 \text{ wt. \%}) * 100}{(\text{Predicted } H_2 \text{ Wt. \%} - \text{Predicted Catalyst Hydrogen Wt. \%})}$$

only. The equations determined in each case are given in the appropriate tables.

The percent changes in coke were calculated in the following manner:

$$\% \text{ Change Coke} = \frac{(\text{Wt. \% coke of Ce run} - \text{Avg. Wt. \% coke of metals only runs}) * 100}{\text{Avg. Wt. \% coke in metals only runs}}$$

TABLE 1

| | | | | | Data for FCC Commercial Catalyst A | | | | | | | | |
|---|---|---|---|---|---|---|---|---|---|---|---|---|---|
| | | | | | | Avg. Actual | | | Molar Ratios | | % Change In | | |
| Ce Cmpd | Ce ppm | V ppm | Ni ppm | C/O | Nos. Test | Wt. % Conv. | Wt. % $H_2$ | Wt. % Coke | Ce/ Ni | Ce/ V + Ni | Wt. % Conv. | $H_2$ | Coke |
| | | | | | Steaming Temperature = 732° C. | | | | | | | | |
| None | 0 | 0 | 0 | 3.00 | 1 | 68.9 | 0.06 | 1.5 | — | — | — | — | — |
| None | 0 | 3000 | 1500 | 3.00 | 2 | 55.5 | 0.59 | 3.0 | 0.00 | 0.00 | 0 | 0 | 0 |
| $O_2$ | 3000 | 3000 | 1500 | 3.00 | 2 | 54.5 | 0.60 | 2.2 | 0.84 | 0.25 | −1 | 2 | −25 |
| Oct | 3000 | 3000 | 1500 | 3.00 | 2 | 58.3 | 0.56 | 2.6 | 0.84 | 0.25 | 4 | −6 | −12 |
| None | 0 | 0 | 3000 | 3.00 | 2 | 65.9 | 0.63 | 3.7 | 0.00 | 0.00 | 0 | 0 | 0 |
| $O_2$ | 1500 | 0 | 3000 | 3.00 | 2 | 59.1 | 0.54 | 2.2 | 0.21 | 0.21 | −7 | −16 | −41 |
| Oct | 1500 | 0 | 3000 | 3.00 | 2 | 59.7 | 0.50 | 2.9 | 0.21 | 0.21 | −6 | −22 | −21 |
| | | | | | Steaming Temperature = 760° C. | | | | | | | | |
| None | 0 | 0 | 0 | 3.03 | 2 | 56.5 | 0.06 | 1.1 | — | — | — | — | — |
| None | 0 | 0 | 0 | 4.44 | 2 | 70.5 | 0.07 | 3.3 | — | — | — | — | — |
| None | 0 | 0 | 2000 | 3.02 | 4 | 53.5 | 0.42 | 2.4 | 0.00 | 0.00 | 0 | 0 | 0 |
| None | 0 | 0 | 2000 | 4.44 | 4 | 66.2 | 0.63 | 2.8 | 0.00 | 0.00 | 0 | 0 | 0 |
| None | 0 | 0 | 2000 | 5.95 | 2 | 75.6 | 0.94 | 3.7 | 0.00 | 0.00 | 0 | 0 | 0 |
| Oct | 1000 | 0 | 2000 | 2.96 | 1 | 62.5 | 0.36 | 4.2 | 0.21 | 0.21 | 6 | −45 | 71 |
| Oct | 1000 | 0 | 2000 | 4.55 | 2 | 79.5 | 0.63 | 6.8 | 0.21 | 0.21 | 13 | −38 | 146 |
| Oct | 2000 | 0 | 2000 | 3.02 | 1 | 63.6 | 0.35 | 4.5 | 0.42 | 0.42 | 10 | −49 | 86 |
| Oct | 2000 | 0 | 2000 | 4.39 | 1 | 68.8 | 0.51 | 5.1 | 0.42 | 0.42 | 3 | −34 | 85 |
| Oct | 3000 | 0 | 2000 | 4.30 | 1 | 70.3 | 0.43 | 5.8 | 0.63 | 0.63 | 4 | −49 | 110 |
| Oct | 3000 | 0 | 2000 | 2.97 | 1 | 57.2 | 0.32 | 3.7 | 0.63 | 0.63 | 4 | −38 | 52 |
| | | | | | Steaming Temperature = 788° C. | | | | | | | | |
| None | 0 | 0 | 0 | 2.94 | 2 | 49.0 | 0.04 | 2.6 | — | — | — | — | — |
| None | 0 | 0 | 0 | 4.47 | 2 | 71.4 | 0.06 | 4.1 | — | — | — | — | — |
| None | 0 | 0 | 2000 | 2.96 | 4 | 42.4 | 0.33 | 2.7 | 0.00 | 0.00 | 0 | 0 | 0 |
| None | 0 | 0 | 2000 | 4.43 | 4 | 56.2 | 0.56 | 3.1 | 0.00 | 0.00 | 0 | 0 | 0 |
| None | 0 | 0 | 2000 | 6.01 | 2 | 68.5 | 0.83 | 2.6 | 0.00 | 0.00 | 0 | 0 | 0 |
| Oct | 1000 | 0 | 2000 | 4.56 | 1 | 55.3 | 0.47 | 3.8 | 0.21 | 0.21 | −1 | −19 | 21 |
| Oct | 1000 | 0 | 2000 | 2.93 | 1 | 43.8 | 0.30 | 2.2 | 0.21 | 0.21 | 1 | −14 | −20 |
| Oct | 2000 | 0 | 2000 | 3.08 | 1 | 45.4 | 0.27 | 2.3 | 0.42 | 0.42 | 3 | −30 | −16 |
| Oct | 2000 | 0 | 2000 | 4.54 | 1 | 50.0 | 0.42 | 3.0 | 0.42 | 0.42 | −6 | −13 | −4 |
| Oct | 3000 | 0 | 2000 | 3.01 | 1 | 43.1 | 0.27 | 2.2 | 0.63 | 0.63 | 1 | −22 | −18 |
| Oct | 3000 | 0 | 2000 | 4.57 | 1 | 58.4 | 0.41 | 3.8 | 0.63 | 0.63 | 2 | −33 | 21 |

Predicted Hydrogen Weight %: at 760° C. = 0.00104*C/O + 0.0226*conv. − 0.823
at 788° C. = 0.0196*C/O + 0.0168*conv. − 0.449
Predicted Cat. $H_2$ = 0.000778*conv. + 0.0107

Predicted hydrogen weight percent data were determined by a least squares linear fit of the vanadium and/or nickel contaminated catalyst runs for each catalyst. Predicted catalyst hydrogen weight percent data were determined by a least squares fit of the fresh catalysts It is apparent from the percent change of hydrogen data in Table 1 that cerium in the form of the octoate (Oct) greatly decreases the amount of hydrogen make that is attributed to the nickel contamination. Additionally, the weight percent changes in the conversions are relatively small. Also, the catalysts passivated with cerium resulted in lower coke values when steamed at 732° C. or 788° C.

TABLE 2

| | | | | | Data for FCC Commercial Catalyst B | | | | | | | | |
|---|---|---|---|---|---|---|---|---|---|---|---|---|---|
| | | | | | Avg. Actual | | | Molar Ratios | | | % Change In | | |
| Ce Cmpd | Ce ppm | V ppm | Ni ppm | Nos. Test | Wt. % Conv. | Wt. % $H_2$ | Wt. % Coke | Ce/ V | Ce/ Ni | Ce/ V + Ni | Wt. % Conv. | $H_2$ | Coke |
| | | | | | Steaming Temperature = 732° C. | | | | | | | | |
| None | 0 | 0 | 0 | 9 | 74.1 | 0.08 | 4.4 | 0.00 | — | | — | — | — |
| None | 0 | 3000 | 1500 | 23 | 62.1 | 0.46 | 3.7 | 0.00 | 0.00 | 0.00 | 0 | 0 | 0 |
| $NO_3$ | 1500 | 3000 | 1500 | 3 | 62.8 | 0.55 | 2.5 | 0.18 | 0.42 | 0.31 | 1 | 32 | −31 |
| $NO_3$ | 2000 | 3000 | 1500 | 2 | 61.4 | 0.49 | 2.6 | 0.24 | 0.56 | 0.17 | −1 | 16 | −19 |
| $NO_3$ | 3000 | 3000 | 1500 | 3 | 64.1 | 0.38 | 2.3 | 0.36 | 0.84 | 0.25 | 2 | −16 | −38 |
| $NO_3$ | 4000 | 3000 | 1500 | 3 | 66.4 | 0.52 | 3.0 | 0.49 | 1.12 | 0.34 | 4 | 13 | −19 |
| $NO_3$ | 8000 | 3000 | 1500 | 3 | 64.3 | 0.54 | 4.1 | 0.97 | 2.25 | 0.68 | 2 | 16 | 11 |
| $O_2$ | 500 | 3000 | 1500 | 5 | 62.1 | 0.47 | 4.0 | 0.06 | 0.14 | 0.04 | 0 | 2 | 10 |
| $O_2$ | 1000 | 3000 | 1500 | 4 | 62.7 | 0.48 | 3.7 | 0.12 | 0.28 | 0.08 | 1 | 5 | 2 |
| $O_2$ | 1500 | 3000 | 1500 | 2 | 60.6 | 0.56 | 3.3 | 0.18 | 0.42 | 0.13 | −2 | 27 | −9 |

TABLE 2-continued

| | | | | | Data for FCC Commercial Catalyst B | | | | | | | | |
|---|---|---|---|---|---|---|---|---|---|---|---|---|---|
| | | | | | Avg. Actual | | | Molar Ratios | | | % Change In | | |
| Ce Cmpd | Ce ppm | V ppm | Ni ppm | Nos. Test | Wt. % Conv. | Wt. % $H_2$ | Wt. % Coke | Ce/V | Ce/Ni | Ce/V + Ni | Wt. % Conv. | $H_2$ | Coke |
| $O_2$ | 2000 | 3000 | 1500 | 8 | 66.1 | 0.58 | 3.8 | 0.24 | 0.56 | 0.17 | 4 | 26 | 3 |
| $O_2$ | 4000 | 3000 | 1500 | 3 | 71.6 | 0.36 | 3.1 | 0.49 | 1.12 | 0.34 | 9 | −39 | −17 |
| $O_2$ | 8000 | 3000 | 1500 | 3 | 67.3 | 0.45 | 3.7 | 0.97 | 2.25 | 0.68 | 5 | −11 | 2 |
| Oct | 750 | 3000 | 1500 | 3 | 65.4 | 0.48 | 4.9 | 0.09 | 0.21 | 0.06 | 3 | −8 | 34 |
| Oct | 1500 | 3000 | 1500 | 3 | 63.3 | 0.46 | 4.7 | 0.18 | 0.42 | 0.13 | 1 | −8 | 29 |
| Oct | 3000 | 3000 | 1500 | 2 | 72.9 | 0.36 | 3.8 | 0.36 | 0.84 | 0.25 | 11 | −45 | 4 |
| Org | 1000 | 3000 | 1500 | 3 | 64.6 | 0.46 | 5.3 | 0.12 | 0.28 | 0.08 | 3 | −13 | 44 |
| Org | 2000 | 3000 | 1500 | 3 | 64.0 | 0.44 | 3.5 | 0.24 | 0.56 | 0.17 | 2 | −5 | −5 |
| Org | 4000 | 3000 | 1500 | 3 | 62.9 | 0.48 | 3.5 | 0.49 | 1.12 | 0.34 | 1 | 5 | −3 |
| Org | 5000 | 3000 | 1500 | 2 | 68.9 | 0.47 | 3.4 | 0.61 | 1.40 | 0.42 | 7 | −8 | −7 |

Predicted Weight % $H_2$ = 0.0070*Conv. − 0.024*Coke − 0.063

From the data in Table 2, it is apparent that cerium reduces hydrogen make especially when the cerium is in the form of an organic compound, and in particular the octoate. At the same time, the increases in conversion are small, except when 3000 to 5000 ppm cerium for various compounds was used. Considering the 3,000 ppm of vanadium on the present Catalyst B versus the 3800 ppm of vanadium on the catalyst in German Pat. No. 3,634,304, the change in percent conversion is much smaller in our case (about 12%) versus the case (about 24%) in German Patent No. 3,634,304. Thus, the cerium is a better passivator of nickel than vanadium. Also, the catalysts passivated with cerium had some effects on coke reduction in these experiments.

TABLE 3

| | | | | | Data for FCC Commercial Catalyst C | | | | | | |
|---|---|---|---|---|---|---|---|---|---|---|---|
| | | | | | Avg. Actual | | | Molar | % Change In | | |
| Ce | Ce ppm | Ni ppm | C/O | Nos. Test | Wt. % Conv. | Wt. % $H_2$ | Wt. % Coke | Ratio Ce/Ni | Wt. % Conv. | $H_2$ | Coke |
| | | | | | Steaming Temperature = 760° C. | | | | | | |
| None | 0 | 0 | 3.03 | 2 | 67.1 | 0.08 | 3.0 | — | — | — | — |
| None | 0 | 0 | 4.55 | 2 | 76.3 | 0.12 | 4.5 | — | — | — | — |
| None | 0 | 2000 | 3.02 | 4 | 59.5 | 0.50 | 2.4 | 0.00 | 0 | 0 | 0 |
| None | 0 | 2000 | 4.49 | 4 | 70.7 | 0.70 | 3.7 | 0.00 | 0 | 0 | 0 |
| Oct | 1500 | 2000 | 2.96 | 1 | 55.8 | 0.41 | 2.9 | 0.32 | −4 | −20 | 21 |
| Oct | 1500 | 2000 | 4.45 | 1 | 73.9 | 0.63 | 3.7 | 0.32 | 4 | −9 | 0 |
| Oct | 3000 | 2000 | 2.94 | 1 | 59.9 | 0.52 | 2.2 | 0.63 | 0 | 7 | −11 |
| Oct | 3000 | 2000 | 4.43 | 1 | 72.5 | 0.64 | 3.7 | 0.63 | 2 | −8 | 0 |
| Oct | 1500 | 0 | 2.93 | 1 | 59.8 | 0.07 | 2.2 | 0.00 | −7 | 9 | −26 |
| Oct | 1500 | 0 | 4.55 | 1 | 72.5 | 0.12 | 3.8 | 0.00 | −4 | 30 | −16 |
| | | | | | Steaming Temperature = 788° C. | | | | | | |
| None | 0 | 0 | 3.01 | 2 | 50.9 | 0.09 | 1.9 | — | — | — | — |
| None | 0 | 0 | 4.55 | 2 | 64.5 | 0.12 | 2.3 | — | — | — | — |
| None | 0 | 2000 | 3.06 | 4 | 52.8 | 0.47 | 2.6 | 0.00 | 0 | | 0 |
| None | 0 | 2000 | 4.50 | 4 | 63.3 | 0.72 | 3.2 | 0.00 | 0 | | 0 |
| Oct | 1500 | 2000 | 3.00 | 2 | 41.7 | 0.51 | 2.3 | 0.32 | −11 | 9 | −15 |
| Oct | 1500 | 2000 | 4.36 | 1 | 57.4 | 0.74 | 3.7 | 0.32 | −6 | 6 | 15 |
| Oct | 3000 | 2000 | 2.97 | 1 | 32.1 | 0.54 | 2.3 | 0.63 | −21 | 15 | −15 |
| Oct | 3000 | 2000 | 4.30 | 1 | 56.7 | 0.61 | 2.9 | 0.63 | −6 | −14 | −9 |
| Oct | 1500 | 0 | 3.08 | 1 | 41.3 | 0.25 | 1.5 | 0.00 | −10 | 260 | −18 |
| Oct | 1500 | 0 | 4.49 | 1 | 57.5 | 0.30 | 2.2 | 0.00 | −7 | 200 | 0 |

Predicted Hydrogen Weight %: at 760° C. = 0.162*C/O − 0.00333*conv. + 0.2085
at 788° C. = 0.176*C/O − 0.000597*conv. − 0.0317
Predicted Cat. $H_2$: at 760° C. = 0.00404*conv. − 0.19
at 788° C. = 0.00196*conv. − 0.00885

For the data in Table 3, only slight improvements can be noted in reducing hydrogen make. It should be noted that when cerium alone was added to the catalyst, large increases in hydrogen make were observed and small decreases in activity were also noted. Thus, overfeeding of cerium could be detrimental to catalyst activity and hydrogen make.

TABLE 4

| | | | | | Data for FCC Commercial Catalyst D | | | | | | | |
|---|---|---|---|---|---|---|---|---|---|---|---|---|
| | | | | | Avg. Actual | | | Molar Ratios | | % Change In | | |
| Ce | Ce ppm | V ppm | Ni ppm | Nos. Test | Wt. % Conv. | Wt. % $H_2$ | Wt. % Coke | Ce/Ni | Ce/V + Ni | Wt % Conv. | $H_2$ | Coke |
| | | | | | Steaming Temperature = 732° C. | | | | | | | |
| None | 0 | 0 | 0 | 4 | 77.5 | 0.05 | 3.6 | — | — | — | — | — |
| None | 0 | 3000 | 1500 | 5 | 64.4 | 0.56 | 3.3 | 0.00 | 0.00 | 0 | 0 | 0 |
| $NO_3$ | 3000 | 3000 | 1500 | 1 | 68.4 | 0.53 | 3.1 | 0.84 | 0.25 | 4 | −6 | −7 |
| Oct | 3000 | 3000 | 1500 | 1 | 69.7 | 0.53 | 3.4 | 0.84 | 0.25 | 5 | −6 | 2 |
| None | 0 | 0 | 4000 | 3 | 75.6 | 0.62 | 4.9 | 0.00 | 0.00 | 0 | 0 | 0 |
| $NO_3$ | 3000 | 0 | 4000 | 1 | 72.0 | 0.52 | 3.0 | 0.32 | 0.32 | −4 | −18 | −39 |

TABLE 4-continued

| | | | | | Data for FCC Commercial Catalyst D | | | | | | | |
|---|---|---|---|---|---|---|---|---|---|---|---|---|
| | | | | | Avg. Actual | | | Molar Ratios | | % Change In | | |
| Ce | Ce ppm | V ppm | Ni ppm | Nos. Test | Wt. % Conv. | Wt. % $H_2$ | Wt. % Coke | Ce/ Ni | Ce/ V + Ni | Wt % Conv. | $H_2$ | Coke |
| Oct | 3000 | 0 | 4000 | 1 | 74.8 | 0.70 | 3.7 | 0.32 | 0.32 | −1 | 14 | −24 |

For Catalyst D, the percent changes in hydrogen and coke were reduced when passivated with cerium compounds.

For completeness, all data obtained during these experiments have been included. Efforts to exclude any value outside acceptable test error limits have not been made. It is believed that, during the course of these experiments, possible errors in preparing samples and in making measurements may have been made which may account for the occasional data point that is not supportive of this art.

It is apparent from the foregoing that catalysts treated in accordance with the procedures and treatment levels as prescribed by the present innovation permitted reduction in hydrogen attributed primarily to the nickel contaminant.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What I claim is:

1. In a method for cracking a hydrocarbon which comprises:

a. contacting a hydrocarbon feedstock with a fluidized zeolite-containing cracking catalyst in a cracking zone under cracking condition;

b. recovering the cracked products;

c. passing the cracking catalyst from the cracking zone to a regeneration zone;

d. regenerating the cracking catalyst in the regeneration zone by contact with oxygen-containing gas under regeneration conditions to produce a regenerated catalyst; and e. introducing the regenerated catalyst to the cracking zone for contact with the hydrocarbon feedstock;

wherein the catalyst during the cracking process is contaminated with nickel contained in a feedstock, wherein nickel increases hydrogen and coke yield at the cracking temperatures and conditions in the cracking zone;

the improvement comprising treating the feedstock containing the nickel contamination with cerium in an amount being from 0.005 to 8,000 ppm based on the concentration of the nickel in the feedstock.

2. A method according to claim 1 wherein the amount of cerium utilized being from 0.005 to 240 ppm based on the concentration of the nickel in the feedstock.

3. A method according to claim 1 wherein the cerium to nickel atomic ratio is 1:1 to 0.05:1 Ce/Ni.

4. A method according to claim 1 wherein the cerium to nickel atomic ratio is 0.66:1 to 0.1:1 Ce/Ni.

5. A method according to claim 1 wherein the feedstock is treated with cerium on a continuous basis.

6. A method according to claim 2 wherein the feedstock is treated with cerium on a continuous basis.

7. A method according to claim 3 wherein the feedstock is treated with cerium on a continuous bases.

8. A method according to claim 4 wherein the feedstock is treated with cerium on a continuous basis.

9. A method according to claims 2, 3, 4, or 5 wherein the cerium is provided through the treatment of the feedstock with cerium octoate.

10. A method according to claims 2, 3, 4, or 5 wherein the cerium is provided through the treatment of the feedstock with cerium nitrate.

11. A method according to claim 2, 3, 4, or 5 wherein the cerium is provided through the treatment of the feedstock with cerium oxide.

12. A method according to claim 11 wherein the cerium oxide is in a water or hydrocarbon base suspension.

* * * * *